US009364894B2

(12) United States Patent
Hirano et al.

(10) Patent No.: US 9,364,894 B2
(45) Date of Patent: Jun. 14, 2016

(54) METHOD OF TREATING THE SURFACE OF A CAVITY OF A DIE USED FOR CASTING

(75) Inventors: Masao Hirano, Kitanagoya (JP); Yoshitaka Horibe, Kitanagoya (JP)

(73) Assignee: J. SINTOKIOGIO, LTD., Nagoya-Shi, Aichi (JP)

( * ) Notice: Subject to any disclaimer, the term of this patent is extended or adjusted under 35 U.S.C. 154(b) by 787 days.

(21) Appl. No.: 13/255,760

(22) PCT Filed: Mar. 8, 2010

(86) PCT No.: PCT/JP2010/053776

§ 371 (c)(1), (2), (4) Date: Nov. 18, 2011

(87) PCT Pub. No.: WO2010/104032

PCT Pub. Date: Sep. 16, 2010

(65) Prior Publication Data

US 2012/0052194 A1 Mar. 1, 2012

(30) Foreign Application Priority Data

Mar. 11, 2009 (JP) ..... 2009-058435

(51) Int. Cl.

*B28B 7/38* (2006.01)
*B22D 17/22* (2006.01)
*B22C 9/06* (2006.01)

(52) U.S. Cl.

CPC ..... *B22D 17/22* (2013.01); *B22C 9/061* (2013.01)

(58) Field of Classification Search

CPC ..... C21D 7/06; B22C 9/061; B22D 17/22
USPC ..... 427/133, 135; 219/39, 52, 56; 72/53; 29/90.7

See application file for complete search history.

(56) References Cited

U.S. PATENT DOCUMENTS 4,581,913 A * 4/1986 Reed ..... 72/53
5,318,091 A * 6/1994 Pavoni et al. ..... 164/6

(Continued)

FOREIGN PATENT DOCUMENTS

JP 06-297103 10/1994
JP 07-246450 9/1995

(Continued)

OTHER PUBLICATIONS

International Search Report dated Apr. 27, 2010 issued in International Application No. PCT/JP2010/053776.

*Primary Examiner* — Michael Wieczorek
(74) *Attorney, Agent, or Firm* — Finnegan, Henderson, Farabow, Garrett & Dunner, L.L.P.

(57) ABSTRACT

Disclosed is a method of processing the surface of a cavity a casting die wherein the fluidity is good even if the shape of the surface of the cavity (castings) has a complex shape, mold releasability are excellent, reprocessing is possible, and the life of the die can be prolonged. A step (A) for forming hemispherical first dimples (12) by the particles to be sprayed on the surface of the cavity (11), and a step (B) for forming second dimples (13) by the particles to be sprayed, which second dimples are smaller than the first dimples (12), are provided. A treating method (a) and a treating method (b) where either step (A) or step (B) is carried out depending on the requirements, and a method (c), where only the first dimples (12) are formed by carrying out only step (A) are also provided.

7 Claims, 4 Drawing Sheets

(56) References Cited

U.S. PATENT DOCUMENTS

| | | | | |
|---|---|---|---|---|
| 6,267,171 | B1 | 7/2001 | Onuki et al. | |
| 6,415,044 | B1 * | 7/2002 | Simpson et al. | 382/108 |
| 6,431,256 | B1 * | 8/2002 | Ferretti et al. | 164/428 |
| 6,453,977 | B2 * | 9/2002 | Onuki et al. | 164/80 |
| 6,929,051 | B2 * | 8/2005 | Peterson et al. | 164/113 |
| 2001/0052374 | A1 | 12/2001 | Onuki et al. | |
| 2005/0126742 | A1 | 6/2005 | Yamamura et al. | |

FOREIGN PATENT DOCUMENTS

| | | | |
|---|---|---|---|
| JP | 11-226696 | A | 8/1999 |
| JP | 2002-113558 | A | 4/2002 |
| JP | 2003-191166 | | 7/2003 |
| JP | 2008-126248 | A | 6/2008 |

* cited by examiner

[1]

[2]

[3]

METHOD OF TREATING THE SURFACE OF A CAVITY OF A DIE USED FOR CASTING

CROSS REFERENCE TO RELATED APPLICATIONS

This application is a national phase application based on international application number PCT/JP2010/053776, filed Mar. 8, 2010, and claims priority of Japanese Patent Application No. 2009-058435, filed Mar. 11, 2009.

FIELD OF INVENTION

This invention relates to a method of treating a surface of a cavity of a die that is used for casting, etc.

TECHNICAL BACKGROUND

Conventionally a method that uses a die for casting is used to manufacture the parts of an engine of an automobile such as a cylinder head or manifold, etc., from a non-ferrous metal such as aluminum, etc. For a die casting method, various attempts have been made to improve the fluidity of molten metal because if the flow of the molten metal (metal flow) deteriorates, defects such as minute shrinkage cavity, flow marks, etc., are likely to occur on castings. To improve the fluidity of molten metal, one method is to reduce the flow resistance of the molten metal by forming concavo-convex shapes on the surface of the die (the surface of the cavity) thereby reducing the area of contact between the molten metal and the surface of the cavity. A method to improve the fluidity of the molten metal by forming concavo-convex shapes on the surface of the cavity is disclosed, for example, in Patent Document 1. It discloses a method of die casting wherein the molten metal is poured uniformly in all parts of the cavity by having square-shaped concaves and convexes continuously spread side-by side over the surface of the cavity of the die to alternately form the parts that have high and low flow resistances and by having one side of the square-shaped concaves and one side of the convexes inclined toward the direction from which the molten metal is poured.
Patent Document: JP H07-246450

SUMMARY OF THE INVENTION

Problem to be Solved by the Invention

In the above example, the concavo-convex shapes of the die are formed by a surface texturing that corrodes the surface of the cavity by a corrosive liquid such as a nitric acid solution and that produces the concaves and convexes on THE surface of the cavity or by electrical discharge machining. However, method had problems in that the scope of the surface of the cavity that was able to be treated was limited and sufficient fluidity of the molten metal could not be obtained if the die had a cavity of a complex shape. Also, for a method of the surface texturing, there was a problem in that a sufficient fluidity of the molten metal could not be obtained because it could not produce the concavo-convex shapes, of which the sizes, depths, or shapes were highly controlled in the production process.

Also, the method had a problem in that because the concavo-convex shapes that were formed had angular edges that were apt to cause scoring, the release of a casting from the die became less easy (ease of casting release).

Also, if the concavo-convex shapes were inclined in one direction, a parting agent that was applied to the surface of the cavity and that was to facilitate the release of the casting from the die was less likely to remain uniformly on the surface of the cavity, thus lowering the ease of the release of the casting from the die, i.e. low ejecting force.

In view of the above problems, the purpose of the present invention is to provide a method of treating the surface of a cavity of a die that can achieve improved fluidity of the molten metal and has a superior release property (ease of casting release).

Means to Solve Problems

This invention relates to a method of treating the surface of a cavity of a die for casting that can solve the above problems. The first invention uses a technical means wherein it comprises a step A of treating a surface by the particles to be sprayed where first particles to be sprayed of a spherical shape having a hardness that is greater than that of the die for casting, are sprayed against the surface of the cavity and thus form first dimples on the surface of the cavity, whereby the surface of the cavity is made up of the area that has no first dimples formed and the area that has the first dimples formed being intermingled with each other. The words "spherical shape" of the present invention refer not only to a shape having absolute sphericity, but also to a shape having near absolute sphericity.

According to the first invention, in the step of treating a surface by the particles to be sprayed (hereafter, step A) the first dimples are formed, whereby the surface of the cavity that has the area that that has no first dimples formed and the area that has the first dimples formed being intermingled with each other can be formed. The surface of the cavity thus formed has the first dimples uniformly dispersed with no particular sign of direction on the surface, thus reducing the area of the cavity that contacts the molten metal. So, the fluidity of the molten metal on the surface of the cavity can be improved. As described in the seventh invention, the first dimples are formed in hemispherical shapes so that the parting agent that is applied to the surface of the cavity when casting is performed is more likely to remain on the surface of the cavity. Also, unlike the shape of the dimples that are formed by a surface texturing, by forming the dimples to have a hemispherical shape that has no pointed corners, the casting obtained will less likely be damaged from scoring, etc., and also can easily be released from the die. The first dimples are formed by treating a surface by the particles to be sprayed, and thus they can be formed on the surface of the cavity of the dies that have complex shapes of cavities.

The second invention, which recites the method of treating the surface of the cavity of the die for casting according to the first invention, and, also, the sixth invention, which recites the method of treating the surface of the cavity of the die for casting according to the fifth invention, use a technical means where the first particles to be sprayed have diameters of 100 to 1,000 μm.

According to the eighth invention, the first dimples that are formed in step A to have shallow hemisphere shapes should preferably be and can be formed in such a way that the diameters of the openings of the dimples are ten or more times greater than the depths of the dimples. The diameters of the first particles should preferably be from 100 μm to 1,000 μm, as in the second invention.

The third invention, which recites the method of treating the surface of the cavity of the die for casting according to the first invention, uses a technical means wherein the ratio of the area of the first dimples to that of the surface of the cavity is 50 to 90%.

As shown in the third invention, the ratio of the area of the first dimples to that of the surface of the cavity is preferably 50 to 90%. If the ratio is below 50%, the area of the molten metal that contacts the surface of the cavity cannot be reduced sufficiently. Thus the fluidity of the molten metal cannot be sufficiently improved. If the ratio is over 90%, the first dimples overlap each other so that the shape of each first dimple does not form a hemisphere. Because of the shape of the dimples, the parting agent is less likely to remain in the dimples and thus the dimples have an inferior release property (ease of casting release). Moreover, the first dimple is likely to have angular edges. So, the casting is often apt to be accompanied with scorings.

The fourth invention, which recites the method of treating the surface of the cavity of the die for casting according to the first invention, uses a technical means wherein the method further comprises a step of treating a surface by the particles to be sprayed (hereafter, step B). The method forms in step B the second dimples on the surface of the cavity by having second particles, which have smaller diameters than those of the first particles, and which have a hardness that is higher than that of the die for casting. The method forms the surface of the cavity that is made up of the first dimples and the second dimples, which are intermingled with each other.

According to the fourth invention, by step B of the invention, the surface of the cavity can be treated in such a way that the traces of treatment, etc., are eliminated from the surface, and the surface shows no sign of direction. Also, the fine second dimples that improve the fluidity of the molten metal can be formed on the surface of the cavity. Thus the surface of the cavity that is made up of the first dimples and the second dimples intermingled with each other can be formed. The surface of the cavity thus formed, where the first dimples and the second dimples are uniformly dispersed and show no sign of direction, can reduce the area of the molten metal that contacts the surface of the cavity, thereby improving the fluidity of the molten metal. Also, the second dimples, because they are formed by the treatment by particles to be sprayed, can be formed on the surface of the cavity of the die that has a complex shape.

The tenth invention, which recites the method of treating the surface of the cavity of the die for casting according to the fourth or fifth invention, uses a technical means where the second particles to be sprayed have spherical shapes.

The words "spherical shape" of the present invention refer not only to a shape having absolute sphericity but also to a shape of near absolute sphericity.

If the particles to be sprayed that have spherical shapes are used as the second particles to be sprayed as described in the tenth invention, the particles to be sprayed can easily form the second dimples, mostly by means of the reaction of plastic deformation. Such particles to be sprayed exert less grinding effects on the surface of the cavity, so that they do not lower the dimensional accuracy of the die that was treated in the preceding step. Thus they can suitably be used for the purpose of the invention. Also, if the particles to be sprayed having spherical shapes are used, they can also produce a peening effect because of the residual stress they give.

The eleventh invention, which recites the method of treating the surface of the cavity of the die for casting according to the fourth or fifth invention, uses a technical means where the diameters of the second particle to be sprayed are from 10 to 100 μm.

The surface roughness of the surface of the cavity where the second dimples are formed with the second particle to be sprayed in step B preferably has an Ra that is 1.0 μm or less (Rz≈a few μm). So, as in the sixth invention, the diameters of the second particles to be sprayed are preferably from 10 to 100 μm.

The twelfth invention, which recites the method of treating the surface of the cavity of the die for casting according to the fourth or fifth invention, uses a technical means where the distances between the convex parts of the first dimples differ from the distances between the convex parts of the second dimples and the depths of the concave parts of the first dimples differ from the depth of the convex parts of the second dimples.

The particles to be sprayed that are used to form the second dimples are smaller in diameter than the particles to be sprayed that are used to form the first dimples (see the second, sixth, and eleventh inventions). So, the distances between the convex parts and the depths of the concave parts of the second dimples are smaller than those of the first dimples. By the shallow concaves of the dimples formed, the surface of the cavity can eliminate the traces of treatment, etc., that were formed by electrical discharge machining or cutting work, thus having no sign of directions. By the deep concaves of the dimples being formed, the fluidity of the molten metal can be improved. This is because the area of the surface of the cavity that contacts the molten metal can be reduced. By having dimples of different sizes intermingled with each other on the surface, the fluidity of the molten metal during the casting process can be improved (see FIG. 1 [2] and FIG. 2 [2].

BEST MODE OF CARRYING OUT THE INVENTION

Figure 1:
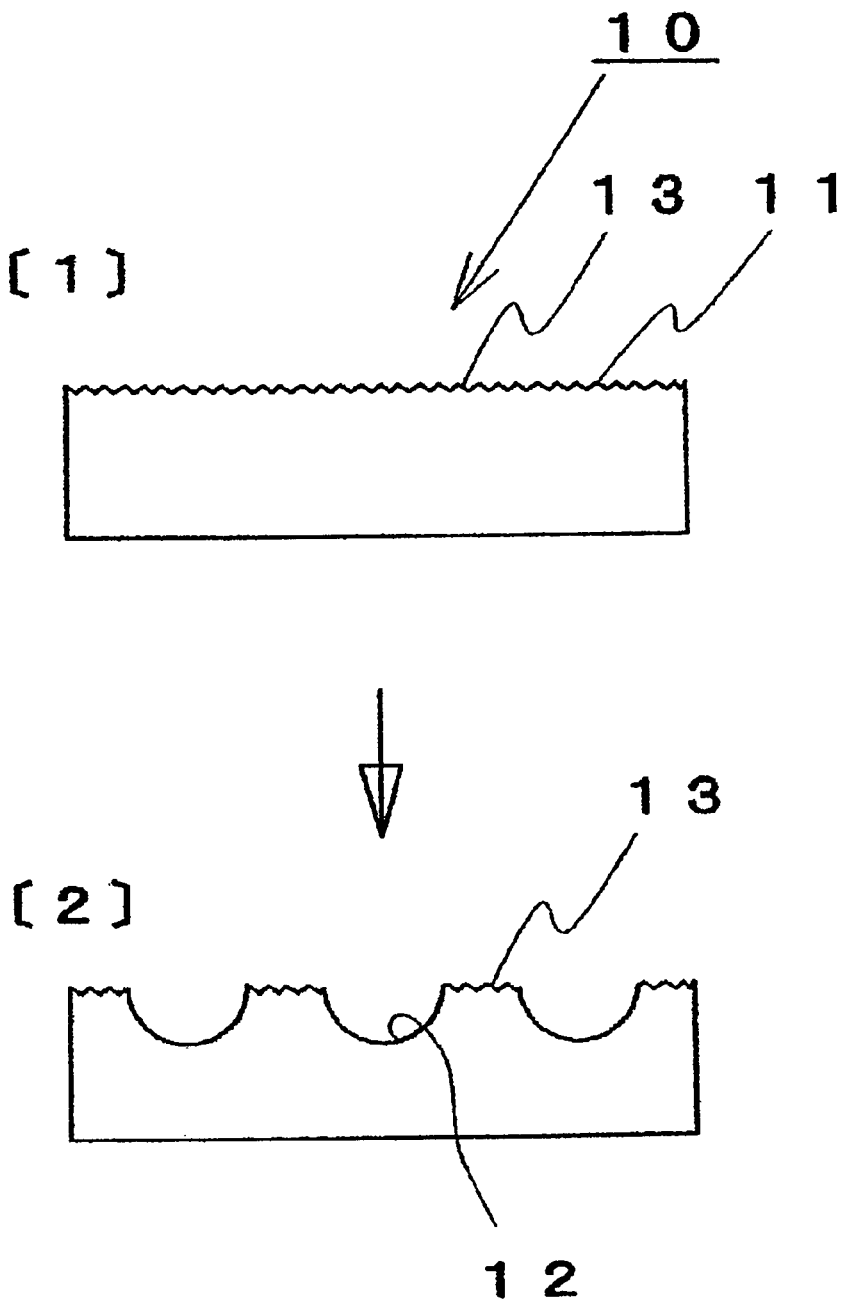
FIG. 1 is a schematic diagram illustrating a cross section of the surface of the cavity that is formed by a treating method (a) that carries out step A after step B is carried out.
Figure 2:
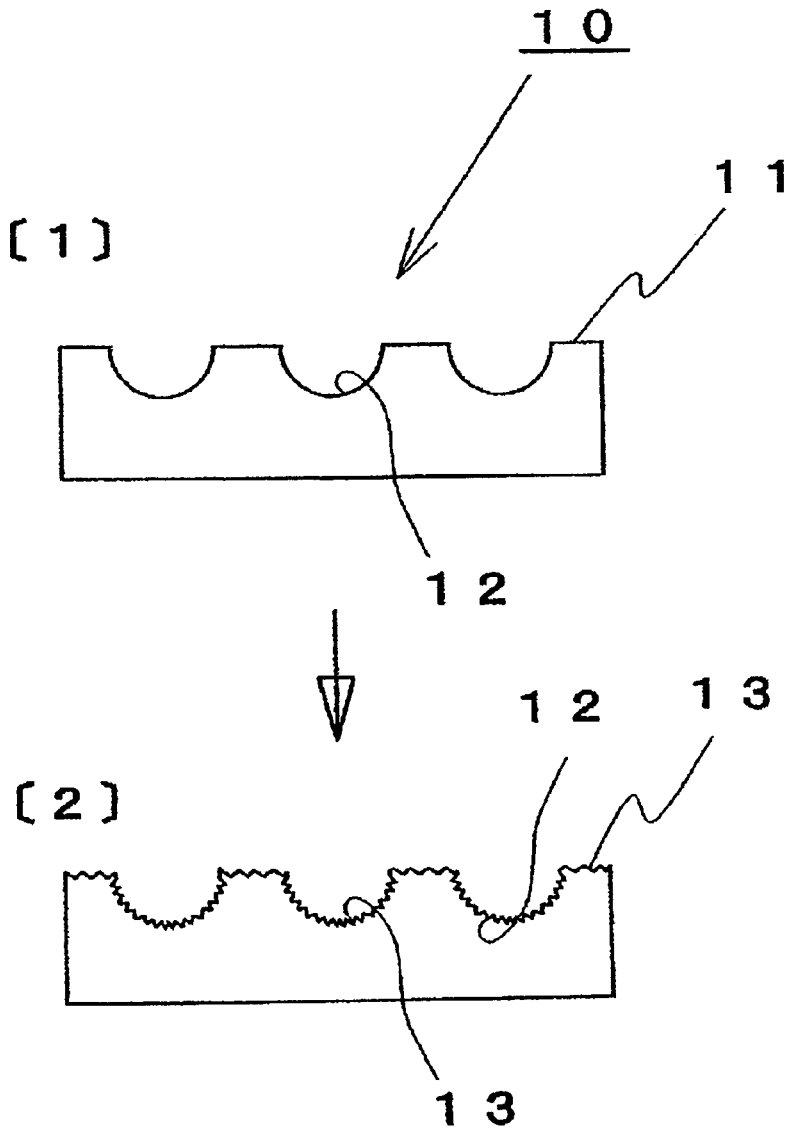
FIG. 2 is a schematic diagram illustrating a cross section of the surface of the cavity that is formed by a treating method (b) that carries out step B after step A is carried out.

The method of treating the surface of the cavity of the die by spraying the particles is explained by referring to the drawings.

FIG. 1 illustrates the step of treating the surface by the treating method (a) to form dimples. [1] of FIG. 1 shows step B, where the surface of the cavity 11, having fine second dimples 13, is formed by having the surface of the cavity treated by a blasting treatment that uses the particles to be sprayed (corresponding to the second particles to be sprayed of the fourth invention) that are made of the material that has the hardness that is the same or greater than that of the material for the die 10.

The object of step B is to cut off the traces of the treatment, etc., that are formed by electrical discharge machining or treatment by grinding the surface of the cavity 11 and to make the surface showing no sign of direction.

At the same time the object is to form the second dimples 13 to improve the fluidity of the molten metal. So, the surface roughness should not be greater than necessary. For example, the surface of the cavity 11 preferably should have a surface roughness of Rz (average roughness of ten points) that is a few μm after it is treated in step B. The shapes of the dimples 13 are not limited, but they should preferably be of a hemispherical shape. The words "hemispherical shape" include a shape of a shallow hemisphere where the diameter of the opening of the dimple is a few times larger than its depth.

To produce a surface of the cavity 11 like this the particles to be sprayed should have the hardness that is the same or greater than the hardness of the material for the die 10. For the material for the die, for example, SKD 61 (JIS G 4404), which is an alloy tool steel for hot-die that is used for die-casting aluminum alloys, etc., can be given. Some of these materials have a Vickers hardness Hv as high as about 500. Particles to be sprayed that have a Vickers hardness of 500 or more, or preferably 700 or more, should preferably be used.

Also, to produce a surface of the cavity 11 that has a surface roughness Rz of a few μm, the diameters of the particles to be sprayed are preferably from about 10 μm to 100 μm.

The particles to be sprayed can be of an indefinite shape, a spherical shape or any other shape. If the particles of an indefinite shape are used, their grinding effect would lower the dimensional accuracy of the die 10. This is because the particles would exert the grinding effect on the surface of the cavity. So, to form the dimples, the particles to be sprayed preferably have spherical shapes that would mostly have an effect of creating a plastic deformation. If the particles to be sprayed have spherical shapes, they also give a peening effect because of the residual stress they give on the cavity. So, the life of the die 10 can be prolonged.

Particles to be sprayed that have these characteristics should preferably be used. One example is shown by the iron amorphous spherical particles that the applicant developed and that was published in the publications of two patent applications, Publication Nos. JP2002-4015 and JP 2005-76083.

FIG. 1, [2] shows step A, where the first dimples 12 that have hemispherical shapes that are larger than those of the second dimples 13 are formed on the second dimples 13 that were formed in step B, with the first dimples 12 being intermingled with the second dimples 13 on the surface of the cavity 11. The first dimples are formed by the blasting treatment using the particles to be sprayed (the particles corresponding to the first particles to be sprayed of the first invention), of which the diameters are greater than those used in step B.

The purpose of step A is to improve the fluidity of the molten metal by reducing the area of the surface of the cavity 11 that contacts the molten metal. To achieve this purpose, the ratio of the area of the first dimples 12 to the surface of the cavity 11 should preferably be 50-90%, and more preferably about 70%. If the ratio is below 50%, a sufficient fluidity of the molten metal cannot be obtained. This is because with that ratio, the area of the molten metal that contacts the surface of the cavity cannot sufficiently be reduced. If the ratio is above 90%, a good release property (ease of casting release) cannot be obtained. This is because that the first dimples 12 overlap each other so that the first dimples 12 are not formed in hemispherical shapes, and thus making it hard to keep the parting agent. Also, the edges of the first dimples 12 have angular shapes such that the scorings will likely to occur at the time of the release of the castings from the die.

Therefore, to have the casting easily released from the die 10, the dimples 12 must be formed in hemispherical shapes that have shallow depths. By having the shapes of the dimples 12 formed in hemispherical shapes and having the dimples 12 uniformly dispersed on the surface of the cavity 11 the parting agent that is applied to the surface of the cavity 11 during a casting process is more likely to remain in the dimples. Also, unlike the dimples formed by surface texturing, the dimples 12 that are formed in hemispherical shapes that have no pointed corners do not cause scorings when the castings are released from the die. So, the release of the castings is easily carried out and thus the castings are less likely to be damaged.

The first dimples 12 are preferably formed as shallow dimples of the hemispherical shapes. The dimples preferably have the ratio of the diameters of the openings to the depth of 10 or more. To produce the dimples having such a ratio, the diameters of the particles to be sprayed are preferably from 100 μm to 1,000 μm. Also, by spraying the particles that have the same hardness as the particles to be sprayed that were used in preceding step B and that have the diameters of about 500 μm, the dimples that have shallow hemispherical shapes, of which depths are about 20 μm deep and the diameters of which openings are about 200 μm wide, can be formed.

To produce a casting using the die 10, whose surface of the cavity 11 was treated by the particles to be sprayed, first a parting agent such as boron nitride, etc., is applied to the surface of the cavity 11 of the die 10. Next, molten metal, such as an aluminum alloy, etc., is poured into the cavity. Then the casting, which is a solidified metal formed from the molten metal, is extruded from the die by an extrusion pin, etc.

Because the surface of the cavity 11 is formed in such a way that the second dimples 13 and the first dimples 12 are intermingled with each other on the surface of the cavity 11, the improved fluidity of the molten metal is obtained and the first dimples 12 can effectively hold the parting agent, resulting in an improved release property (ease of casting release) of the surface of the cavity 11. Thus a casting having no defect, such as minor shrinkage cavities, flow marks, etc., can be manufactured. Further, as the second dimples 13 and the first dimples 12 are formed by the treatment by particles to be sprayed, they are easily formed on the surface of the cavity of the die, which surface has a complex cavity shape.

The method of treating the surface of the cavity of the die for casting of the fifth invention comprises forming the second dimples on the surface of the cavity in the step B wherein the second particles to be sprayed that have diameters that are smaller than those of the first particles to be sprayed and that have hardness that is the same as or greater than that of the die for casting are sprayed against the surface of the cavity.

Then the surface of the cavity where the area that has no second dimples formed and the area that has the second dimples formed are intermingled with each other is produced in step B.

It further comprises forming the first dimples on the surface of the cavity in the step A, wherein the surface of the cavity where the second dimples and first dimples are intermingled with each other can be formed and wherein the first particles to be sprayed having spherical shapes and having hardness that is the same as or greater than that of the die for casting are sprayed against the surface of the cavity.

The order of performing step A and step B is optional. So, as shown in FIG. 1, option (a) is to first perform step B and then, perform step A. Option (b) is to first perform step A, and then, to perform step B. Which one of the treating methods (a) and (b) to choose is determined by the shape of the casting because the fluidity of the molten metal varies depending on the conditions of the treatment carried out on the surface of the cavity 11. Whichever of the two methods that is better suited to the intended purpose can be selected.

Figure 3:
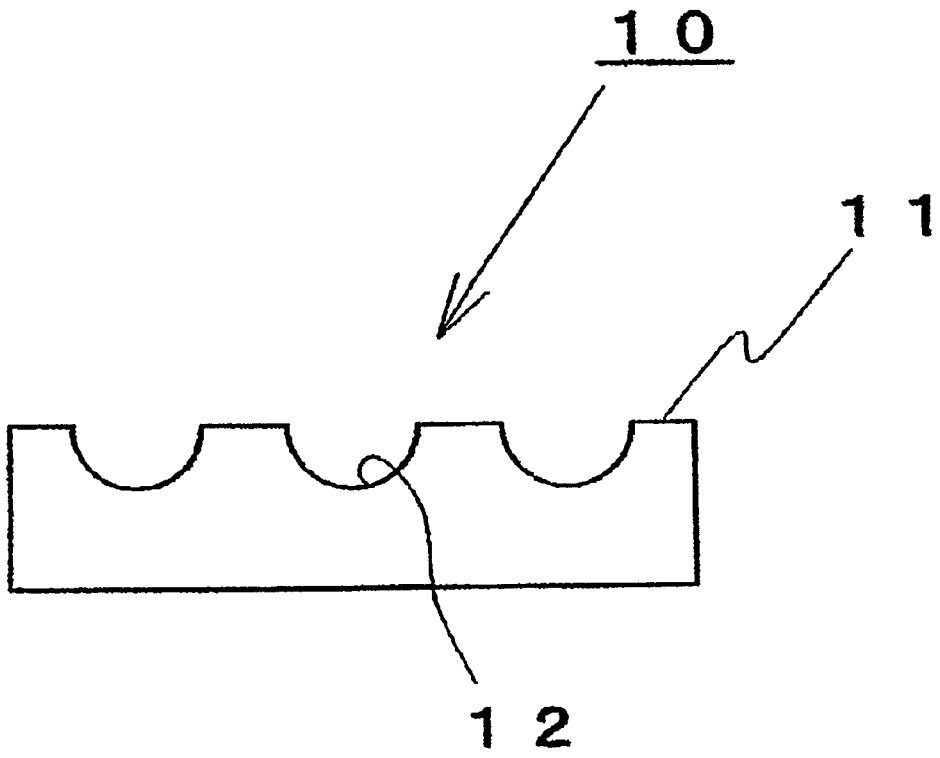
FIG. 3 is a schematic diagram illustrating a cross section of the surface of the cavity that is formed by the treating method (c) that carries out only step A.

If there are not any large traces of the treatment, etc., that disrupt the flow of the molten metal on the surface of the cavity before it is treated by the particles to be sprayed, method (c) as shown in FIG. 3, can be adopted, wherein only step A is performed.

The material for the first particles to be sprayed that are used in step A or the material for the second particles to be sprayed that are used in step B can be any material in so far as it is suitable to form the first dimples 12 or the second dimples 13 depending on the material for the die 10.

Also, the surface of the cavity 11 of the die 10, on which surface the dimples of the present invention are formed, can be modified by heat-treatment or it may have a coating formed by nitride-treatment, etc. If the surface of the cavity 11 that has a coating on it is to be treated, the particles to be sprayed of spherical shapes are used in step B so as not to cause the coating to be separated, etc.

EXAMPLE 1

Figure 4:
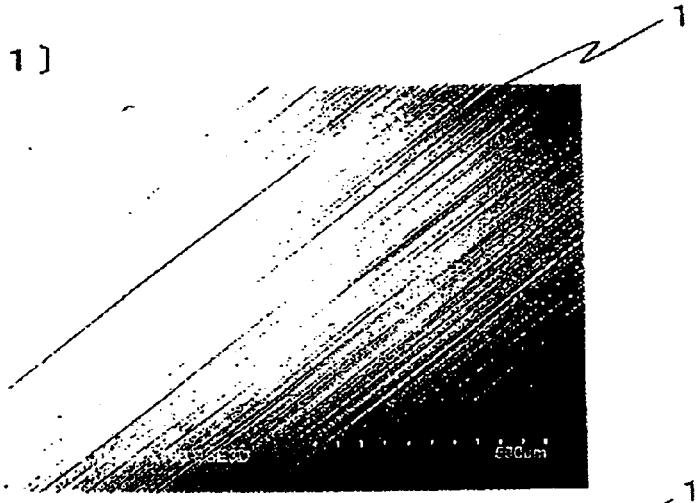
FIG. 4 is an illustration of the surface conditions of a test sample of Example 1 that uses the treating method (a) of the present invention where the test samples are the following: [1] before being subjected to treatment by particles to be sprayed, [2] after being subjected to step B, and [3] after being subjected to step A after step B is carried out.
Figure 4:
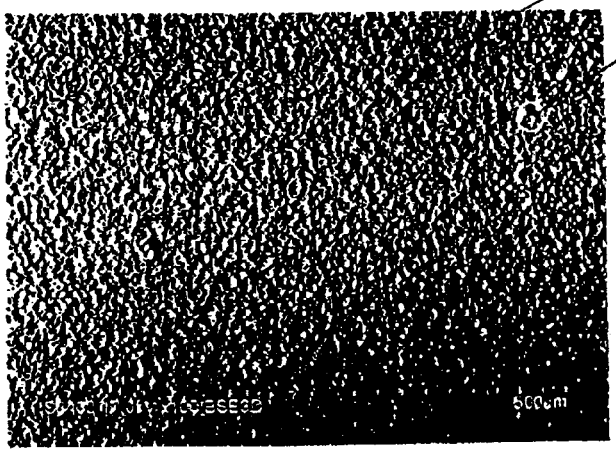
Figure 4:
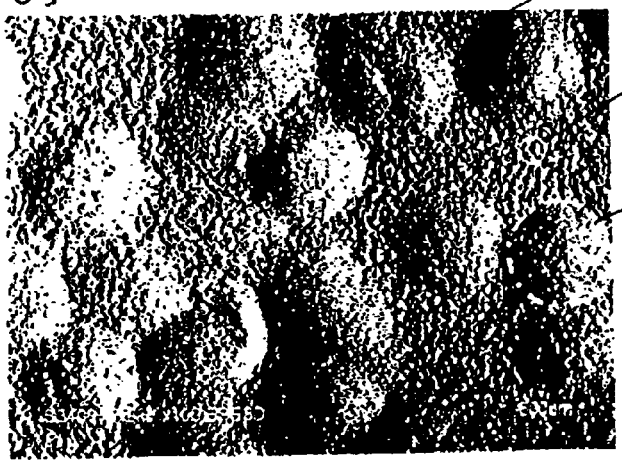

Example 1 shows the embodiment of the treating method (a). FIGS. 4 [1] to [3] shows the surface conditions (the surface of the cavity 11) of the test piece used as the material for the die before and after the surface is treated by the particles to be sprayed. The present example is explained below in detail by referring to these Figs. The present invention is not limited to the embodiment that is explained below.

FIG. 4 [1] shows the surface conditions of the test piece of alloy tool steel SKD61. It was used as the material for the die of the present example. The test piece had a disk-shape having a diameter of 25 mm and it had the traces of treatment on the surface formed in the preceding step. The hardness and surface roughness of the test piece were Hv470 to 500 and Ra 0.07 μm (≈Rz 0.6 μm), respectively.

FIG. 4 [2] shows the surface conditions of the test piece after the surface is treated by particles to be sprayed that are used in the step B as the second particles, which are amorphous particles called "Amobeads"™ (AM-50, manufactured by Sintokogio Ltd.) having a hardness of Hv900 and a spherical shape with a diameter of 50 μm. A blasting apparatus of suction type "My Blast"™ (MY-30A, manufactured by Sintokogio Ltd.) is used as a blasting apparatus, whereby the particles are sprayed for 10 seconds by a spray-pressure of 0.3 MPa, with the distance to be sprayed of 100 mm, and the angle of the nozzle kept at 90 degrees.

Fine second dimples 13, which showed no sign of direction, were able to be formed by cutting off in the treatment performed in step B the traces of the treatment on the surface of the test piece (the surface of the cavity), which traces are shown in FIG. 4 [1]. The surface roughness of the test piece showed Ra0.49 μm (≈Rz2.8 μm).

FIG. 4 [3] shows the surface conditions of the test piece, which surface is treated by the particles to be sprayed of the first particles in step A after the surface was treated by the particles to be sprayed in step B. The first particles have a hardness of Hv700, and are of spherical shaped steel material (SB-6PH, manufactured by Sintokogio Ltd.) having a diameter of 600 μm. A blasting apparatus of a pressure type (MY-30AP manufactured by Sintokogio Ltd.) is used as a blasting apparatus, whereby the particles are sprayed for 7 seconds by a spray-pressure of 0.5 MPa, with the distance to be sprayed of 100 mm, and the angle of the nozzle kept at 90 degrees.

As shown in FIG. 4 [3], on the surface of the test piece (the surface of the cavity 11) the first dimples 12, which were larger than the second dimples 13, were able to be formed in step A on top of the fine second dimples 13 that were formed in preceding step B. The surface roughness of the test piece after it was treated in step A was Ra 2.97 μm (≈Rz12.6 μm). The first dimples 12 that were formed in the step A have the depth of about 13 μm, and have a shallow hemispherical shape, the openings of which have a diameter of about 240 μm. Its area ratio (the ratio of the area of the openings of the dimples 13 to the total surface area of the test piece) was about 70%.

As explained above, the treating method (a) shows that it could produce the surface of the cavity 11 having the second dimples 13 and the first dimples 12 of the shallow hemispherical shape uniformly dispersed and intermingled with each other on the surface.

EXAMPLE 2

In the present embodiment, using a thin sheet that was treated by the die for casting, the molten metal were compared as to the fluidity of the part of the sheet treated by the present method and the fluidity of the part of the sheet treated by the conventional surface texturing. To exclude the effects that might be caused by the difference in the casting conditions, a die whose cavity had a symmetric shape was used. The fluidities of the molten metal of the thin sheet were compared between the left and right halves of the cavity, where the left half of it was treated by the conventional surface texturing and its right half was treated by the particles to be sprayed of the present invention. The fluidities of the molten metal were evaluated by measuring the densities of the left half and the right half of the casting. The density of the casting would be lower if it had an inferior fluidity because of insufficient pouring, sucking of air, etc.

An aluminum alloy (ADC 12: density: 2.72 g/cm$^3$) was used as molten metal, where it had a pouring temperature of 700° C. and the temperature of the die was at 300° C. The density of the part of the cavity of casting that was treated by the surface texturing was 2.70 g/cm$^3$, while the density of the part of the cavity of the casting that was treated by the particles of the present invention was 2.72 g/cm$^3$. The results show that the surface of the cavity that was treated by the method of the present invention has a molten metal with an improved fluidity compared with the surface of the cavity that was treated by the conventional method.

BEST MODE OF THE EMBODIMENT

By the method of treating the surface of the cavity of the present invention, the surface of the cavity can be treated in step B whereby the traces of treatment, etc., on the surface of the cavity are cut-off and thus the surface shows no sign of directions. Also, fine second dimples 13 that improve the fluidity of the molten metal can be formed on the surface of the cavity. Then the first dimples 12, which have hemispherical shapes and that are larger than those of the second dimples 13, are formed.

Thus the surface of the cavity 11 that has the second dimples 13 and the first dimples 12 intermingled with each other on the surface of the cavity can be formed. By so forming the surface of the cavity 11, where the second dimples 13 and the first dimples 12 are uniformly dispersed without any sign of direction, the area of the molten metal that contacts the surface of the cavity 11 can be reduced, thereby improving the fluidity of the molten metal. By having the shapes of the first dimples 12 formed in hemispherical shapes the parting agent that is applied to the surface of the cavity 11 during the casting process is likely to remain in the dimples. Also, unlike the dimples formed by surface texturing, the dimples that are formed in a hemispherical shape have no pointed corners and do not cause scorings when castings are released from the die. So, releasing the castings from the die can be easily performed and thus the castings are less likely to be damaged. Further, as the second dimples 13 and the first dimples 12 are produced by the treatment by the particles to be sprayed, they are easily formed on the surface of the cavity of the die even if the surface has a complex shape.

OTHER EMBODIMENTS

In the embodiments of the present inventions described above, mainly the dies that are used for die casting are explained. But the dies that are treated by the present invention are not limited to those dies. The treating method of the present invention can be applied to the dies that are used in various casting methods, such as a low-pressure casting, vacuum casting, etc.

The basic Japanese Patent Application, No. 2009-058435, filed Mar. 11, 2009, is hereby incorporated in its entirety by reference in the present application.

The present invention will become more fully understood from the detailed description of this specification. However, the detailed description and the specific embodiment illustrate desirable embodiments of the present invention and are described only for the purpose of explanation. Various changes and modifications will be apparent to those of ordinary skills in the art on the basis of the detailed description.

The applicant has no intention to dedicate to the public any disclosed embodiments. Among the disclosed changes and modifications, those that may not literally fall within the scope of the present claims constitute, therefore, a part of the present invention in the sense of the doctrine of equivalents.

The use of the articles "a," "an," and "the," and similar referents in the specification and claims, are to be construed to cover both the singular and the plural, unless otherwise indicated herein or clearly contradicted by the context. The use of any and all examples, or exemplary language (e.g., "such as," etc.) provided herein, is intended merely to better illuminate the invention and does not pose a limitation on the scope of the invention unless otherwise claimed.

SYMBOLS

10 die
11 surface of the cavity
12 first dimple
13 second dimple

The invention claimed is:

1. A method of treating a surface of a cavity of a die for casting comprising step A of treating the surface by sprayed particles where first particles to be sprayed of a spherical shape having a hardness that is greater than that of the die for casting are sprayed against the surface of the cavity and thus form first dimples of hemispherical shapes that have no pointed corners on the surface of the cavity, wherein the first dimples formed to have shallow hemisphere shapes, the diameters of the openings of the dimples that are being ten or more times greater than the depths of the dimple;

further comprising, after step A of treating the surface by first particles is performed, step B of treating the surface by sprayed particles that form second dimples on the surface of the cavity by having second particles that have smaller diameters than those of the first particles and that have a hardness that is higher than that of the die for casting sprayed against the surface, the method forming the surface of the cavity that is made up of the first dimples and the second dimples intermingled with each other and having second dimples formed within the first dimples; and where the surface of the cavity thus formed has the first dimples uniformly dispersed on the surface, wherein the surface of the cavity is treated in step B in such a way that the traces of treatment, are eliminated from the surface thereby improving the fluidity of the molten metal.

2. The method of treating the surface of the cavity of the for casting of claim 1, wherein the first particles to be sprayed have diameters of 100 to 1,000 μm.

3. The method of treating the surface of the cavity of the die for casting of claim 1, wherein the ratio of the area of the first dimples to that of the surface of the cavity is 50 to 90%.

4. The method of treating the surface of the cavity of the for casting of claim 1, wherein the second dimples are formed to have shallow hemisphere shapes.

5. The method of treating the surface of the cavity of the for casting of claim 1, wherein the second particles to be sprayed have spherical shapes.

6. The method of treating the surface of the cavity of the for casting of claim 1, wherein the diameters of the second particles to be sprayed are from 10 to 100 μm.

7. The method of treating the surface of the cavity of the die for casting of claim 1, wherein concave-convex shapes are formed by the first and second dimples, which dimples overlap each other, the distances between the convex parts of the first dimples differ from the distances between the convex parts of the second dimples and the depths of the concave parts of the first dimples differ from the depths of the concave parts of the second dimples.

* * * * *